US010161211B2

(12) United States Patent
Travis et al.

(10) Patent No.: US 10,161,211 B2
(45) Date of Patent: Dec. 25, 2018

(54) RUNNING TOOL LOCKING SYSTEM AND METHOD

(71) Applicant: Stream-Flo Industries Ltd., Edmonton (CA)

(72) Inventors: Todd Anthony Travis, Humble, TX (US); Chi Yao, Houston, TX (US); Eric Calzoncinth, Houston, TX (US); Heinrich Lang, Montgomery, TX (US)

(73) Assignee: Stream-Flo Industries Ltd., Edmonton (CA)

( * ) Notice: Subject to any disclaimer, the term of this patent is extended or adjusted under 35 U.S.C. 154(b) by 265 days.

(21) Appl. No.: 15/337,869

(22) Filed: Oct. 28, 2016

(65) Prior Publication Data

US 2017/0122042 A1 May 4, 2017

Related U.S. Application Data

(60) Provisional application No. 62/248,161, filed on Oct. 29, 2015.

(51) Int. Cl.

| | |
|---|---|
| ***E21B 33/04*** | (2006.01) |
| ***E21B 17/043*** | (2006.01) |
| ***E21B 19/06*** | (2006.01) |
| ***E21B 7/20*** | (2006.01) |
| ***E21B 17/03*** | (2006.01) |

(52) U.S. Cl.

CPC ..... *E21B 33/0415* (2013.01); *E21B 7/20* (2013.01); *E21B 17/03* (2013.01); *E21B 17/043* (2013.01); *E21B 19/06* (2013.01)

(58) Field of Classification Search

CPC ..... E21B 17/043; E21B 17/03; E21B 7/20; E21B 33/0415; E21B 19/16; E21B 19/06; E21B 33/0422

See application file for complete search history.

(56) References Cited

U.S. PATENT DOCUMENTS

| | | | |
|---|---|---|---|
| 6,041,859 | A | 3/2000 | Blades |
| 6,241,018 | B1 | 6/2001 | Eriksen |

(Continued)

OTHER PUBLICATIONS

International Preliminary Report on Patentability, dated May 1, 2018, corresponding to International Application No. PCT/CA2016/000268 (filed Oct. 28, 2016), parent of the present application, 4 pp.

(Continued)

*Primary Examiner* — Michael R Wills, III

(74) *Attorney, Agent, or Firm* — Leydig, Voit & Mayer, Ltd.

(57) ABSTRACT

A system and method for locking together a running tool and a tubular member to rotate the tubular member. The system includes a tubular member and a running tool adapted to engage in a mechanical connection such that the running tool and the tubular member are arranged concentrically and moveable longitudinally together. The system includes a locking assembly adapted to lock the tubular member and the running tool together once the tubular member and the running tool are engaged in the mechanical connection, so that torque applied to the running tool is applied to the tubular member through the locking assembly to rotate the running tool and the tubular member synchronously. The locking assembly is adapted to unlock the tubular member and the running tool when the tubular member is landed on a shoulder of an outer tubular member so that the mechanical connection can then be disengaged.

14 Claims, 19 Drawing Sheets

(56) References Cited

U.S. PATENT DOCUMENTS

| | | | |
|---|---|---|---|
| 6,516,887 | B2 | 2/2003 | Nguyen et al. |
| 7,231,970 | B2 | 6/2007 | Matusek et al. |
| 7,243,958 | B2 | 7/2007 | Williams |
| 8,136,588 | B2 | 3/2012 | Manson |
| 8,453,729 | B2 | 6/2013 | Harris et al. |
| 8,528,650 | B1 | 9/2013 | Smith et al. |
| 8,567,493 | B2 | 10/2013 | June et al. |
| 8,627,895 | B2 | 1/2014 | Fern et al. |
| 8,826,992 | B2 | 9/2014 | Zhou |
| 8,851,183 | B2 | 10/2014 | Yates et al. |
| 8,899,315 | B2 | 12/2014 | Nguyen et al. |
| 8,973,653 | B2 | 3/2015 | Thornburrow et al. |
| 9,458,690 | B2 | 10/2016 | Moellendick |
| 2012/0305269 | A1* | 12/2012 | Bories ..... E21B 33/0415 166/382 |
| 2014/0305659 | A1 | 10/2014 | Boisvert et al. |
| 2014/0311753 | A1 | 10/2014 | Hanson et al. |
| 2015/0041151 | A1 | 2/2015 | Cocker, III et al. |

OTHER PUBLICATIONS

Product Information Page for Seaboard™ Rotating Torque Tool (RTT) by Weir Oil & Gas, Copyright 2013.

International Search Report with Written Opinion corresponding to International Patent Application No. PCT/CA2016/000268, dated Feb. 9, 2017.

* cited by examiner

RUNNING TOOL LOCKING SYSTEM AND METHOD

CROSS REFERENCE TO RELATED APPLICATIONS

This application claims priority from U.S. Provisional Patent Application No. 62/248,161 filed Oct. 29, 2015, which is incorporated by reference herein to the extent that there is no inconsistency with the present disclosure.

FIELD OF THE INVENTION

This invention relates in general to a system and method for locking together a running tool and a tubular member to rotate the tubular member.

BACKGROUND

Running tools are used the oil and gas service industry to install and retrieve equipment or components from wells, either at the wellhead, or downhole. One such use of running tools is in casing-drilling applications. With the onset of complex directional operations and long laterals, casing-drilling has become a preferred method for land wells. This operation requires the casing string to be rotated while drilling. A mandrel casing hanger may also be used to rotate the casing string during cementing of the casing strings in the well operation. Rotating the casing string has benefits, such as increased manoeuverability of the bottomhole assembly (BHA) and drill bit, better circulation and movement of the flow cuttings to the surface, increasing in strength of the pilot hole by packing the walls when cementing, faster and easier installations in horizontal well sections (laterals), less chance of sticking pipe in horizontal sections, and the ability to un-torque or torsionally relax the pipe once it reaches the desired depth. Running tools are used to engage the mandrel casing hanger, and can be used to rotate the casing hanger and the connected casing string during cementing of the casing string. Typically the casing hanger is supported in whole or in part on a load shoulder formed or provided in a casing head. During rotation the casing hanger can be lifted off the load shoulder and supported by a top drive during rotation. Various techniques exist to connect the running tool to the casing hanger and to rotate the casing hanger and the casing string, see for example US Published Patent Applications 2014/0311753 A1 and 2015/0041151 A1, both assigned to Cameron International Corporation and US Published Patent Application 2014/0305659 A1, assigned to Seaboard International, Inc.

In general, torque is applied at the running tool, and is translated through the mandrel casing hanger to the entire casing string to rotate the casing string. Depending on the direction in which the torque is applied, the threaded connection between the running tool and the mandrel casing hanger could be over tightened, making disengagement difficult, or the threaded connection may be backed out, which can drop the casing string or break the seal between the tubular connections.

SUMMARY

In one embodiment a system is provided for locking together a running tool and a tubular member to rotate the tubular member. The system includes a tubular member, and a running tool adapted to engage in a mechanical connection to the tubular member such that the running tool and the tubular member are arranged concentrically and moveable longitudinally together. The system includes a locking assembly adapted to lock the tubular member and the running tool together once the tubular member and the running tool are engaged in the mechanical connection, so that torque applied to the running tool is applied to the tubular member through the locking assembly to rotate the running tool and the tubular member synchronously in a clockwise direction or a counterclockwise direction. The locking assembly is adapted to unlock the tubular member and the running tool when the tubular member is landed on a shoulder of an outer tubular member so that the mechanical connection can then be disengaged.

In some embodiments, the tubular member is a mandrel hanger adapted to suspend a tubular string from a lower portion and the mandrel hanger is formed with a plurality of circumferentially spaced hanger ports. The running tool is adapted to engage in an external mechanical connection, such as a threaded connection to external threads on the mandrel hanger. The mandrel hanger is formed with a plurality of circumferentially spaced running tool ports adapted to be aligned with the hanger ports once the running tool and the mandrel hanger are engaged in the mechanical connection. The locking assembly includes locking pins arranged to engage between the aligned hanger ports and the running tool ports to lock the mandrel hanger and the running tool together once the running tool and the mandrel hanger are engaged in the mechanical connection, so that torque applied to the running tool is applied to the mandrel hanger through the locking pins to rotate the running tool, the mandrel hanger and the tubular string synchronously in a clockwise direction or a counterclockwise direction. The locking assembly is adapted to move the locking pins generally upwardly or downwardly within one or both of the hanger ports and the running tool ports to unlock the mandrel hanger and the running tool when the mandrel hanger is landed on a load shoulder of a wellhead spool so that the mechanical connection can then be disengaged.

In other embodiments, the running tool is adapted to engage in an internal mechanical connection to a mandrel hanger, and the mandrel hanger is formed with a plurality of circumferentially spaced hanger ports. The locking assembly includes an outer locking tubular to be arranged around the mandrel hanger and the running tool, and connected at an upper end to the running tool. The outer locking tubular is adapted to lock the mandrel hanger and the running tool together once the mandrel hanger and the running tool are engaged in the mechanical connection, so that torque applied to the running tool is applied to the mandrel hanger through the outer locking tubular to rotate the running tool, the hanger and the tubular string synchronously in a clockwise direction or a counterclockwise direction. The locking assembly further includes locking pins arranged to engage in the hanger ports to contact a lower end of the outer locking tubular to move the outer locking tubular generally upwardly to unlock the mandrel hanger and the running tool when the mandrel hanger is landed on a load shoulder of a wellhead spool so that the mechanical connection can be disengaged.

There is also broadly provided a method of locking together a running tool and a tubular member to permit concentric longitudinal movement together and to rotate the tubular member prior to landing the tubular member in an outer tubular member. The method includes:

a) forming a mechanical connection between the running tool and the tubular member such that the running tool and the tubular member are arranged concentrically and moveable longitudinally together;

b) locking the tubular member and the running tool together with a locking assembly;

c) applying torque to the running tool to transmit torque through the locking assembly to the tubular member and to rotate the running tool and the tubular member synchronously in a clockwise direction or a counter-clockwise direction;

d) landing the tubular member on a shoulder of the outer tubular member to cause the locking assembly to unlock the tubular member and the running tool; and e) disengaging the mechanical connection between the running tool and the tubular member.

In some embodiments of the method, the tubular member is a mandrel hanger formed with one or both of external and internal running threads at an upper portion and adapted to suspend a tubular string from a lower portion, and the method further includes coupling the tubular string to the mandrel hanger. The running tool is formed with threads to engage the external or internal running threads of the mandrel hanger so that the mechanical connection is a threaded connection. The outer tubular member is a wellhead spool having a load shoulder. The locking assembly is adapted to lock the mandrel hanger and the running tool together once the running tool is threaded onto the mandrel hanger so that torque applied to the running tool is applied to the mandrel hanger through the locking assembly to rotate the running tool, the mandrel hanger and the tubular string synchronously in the clockwise direction or the counter-clockwise direction. The locking assembly unlocks the mandrel hanger and the running tool when the mandrel hanger is landed on the load shoulder of the wellhead spool so that the threaded connection can then be reversed to disengage the running tool from the mandrel hanger.

BRIEF DESCRIPTION ON THE DRAWINGS

FIGS. 5-12 are side sectional views of the torque tool system of FIGS. 1-4, showing the sequence of assembling and making a threaded connection between the running tool and the mandrel casing hanger, locking together the connected running tool and mandrel casing hanger with the retracting pins, and landing the casing hanger in a casing head to unlock the locked connection between the running tool from the casing hanger in order to thereafter remove the running tool by reversing the threaded connection.

Figure 13:
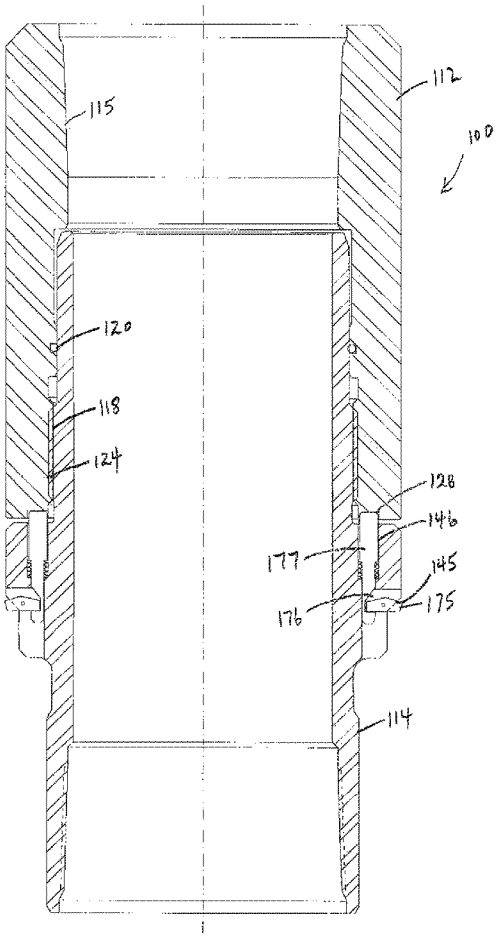

FIG. 13 is a side sectional view of a second embodiment of a torque tool system in which the locking assembly between the running tool and the casing hanger includes a latch which holds the notched base of a spring biassed locking pin in the locking connection of the running tool and the mandrel casing hanger.

Figure 1:
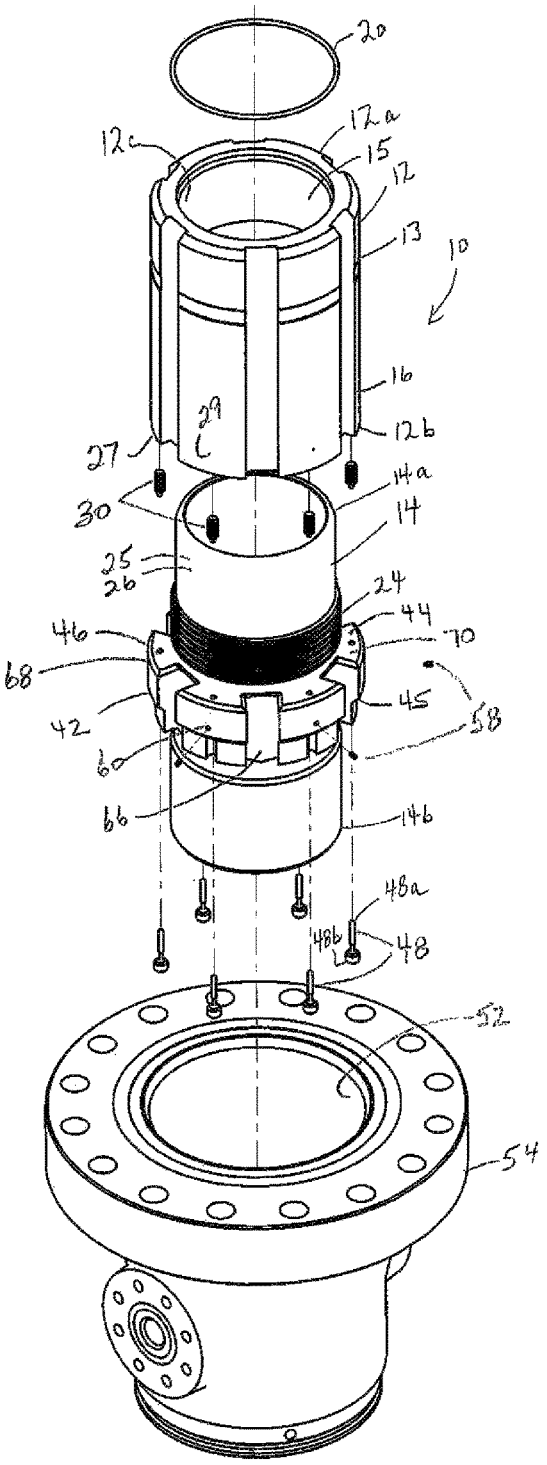
FIG. 1 is a perspective, exploded view of one embodiment of a torque tool system showing an external running tool to be connected and locked to a mandrel casing hanger for rotating a casing string in either direction (clockwise or counterclockwise), and a casing head for landing the system to unlock and disengage the running tool from the hanger.
Figure 2:
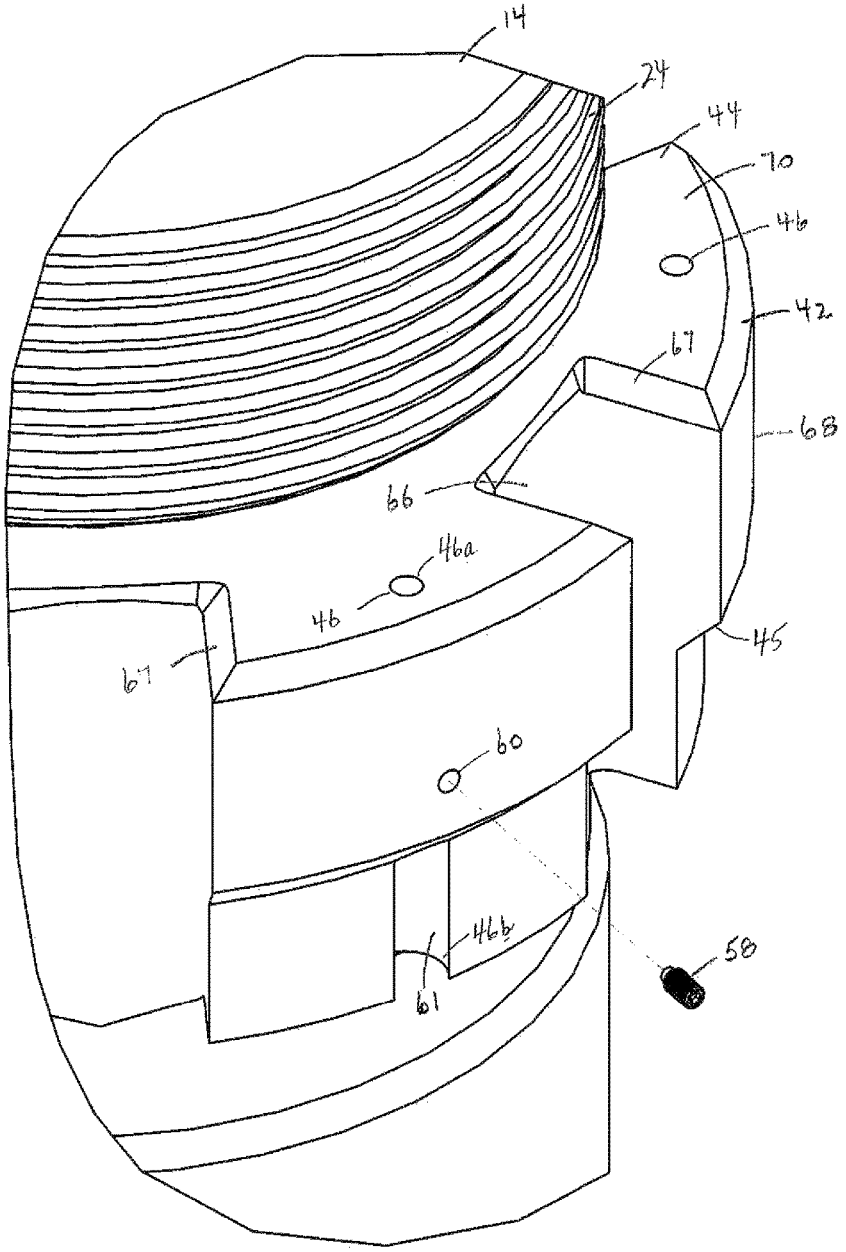
FIG. 2 is an enlarged view of a support shoulder portion of the mandrel casing hanger showing vertical ports for shoulder pins or floating pistons and side ports intersecting the vertical ports for receiving set screws to hold the shoulder pins in upper and lower positions and to prevent the shoulder pins from falling downwardly through the vertical ports.
Figure 3:
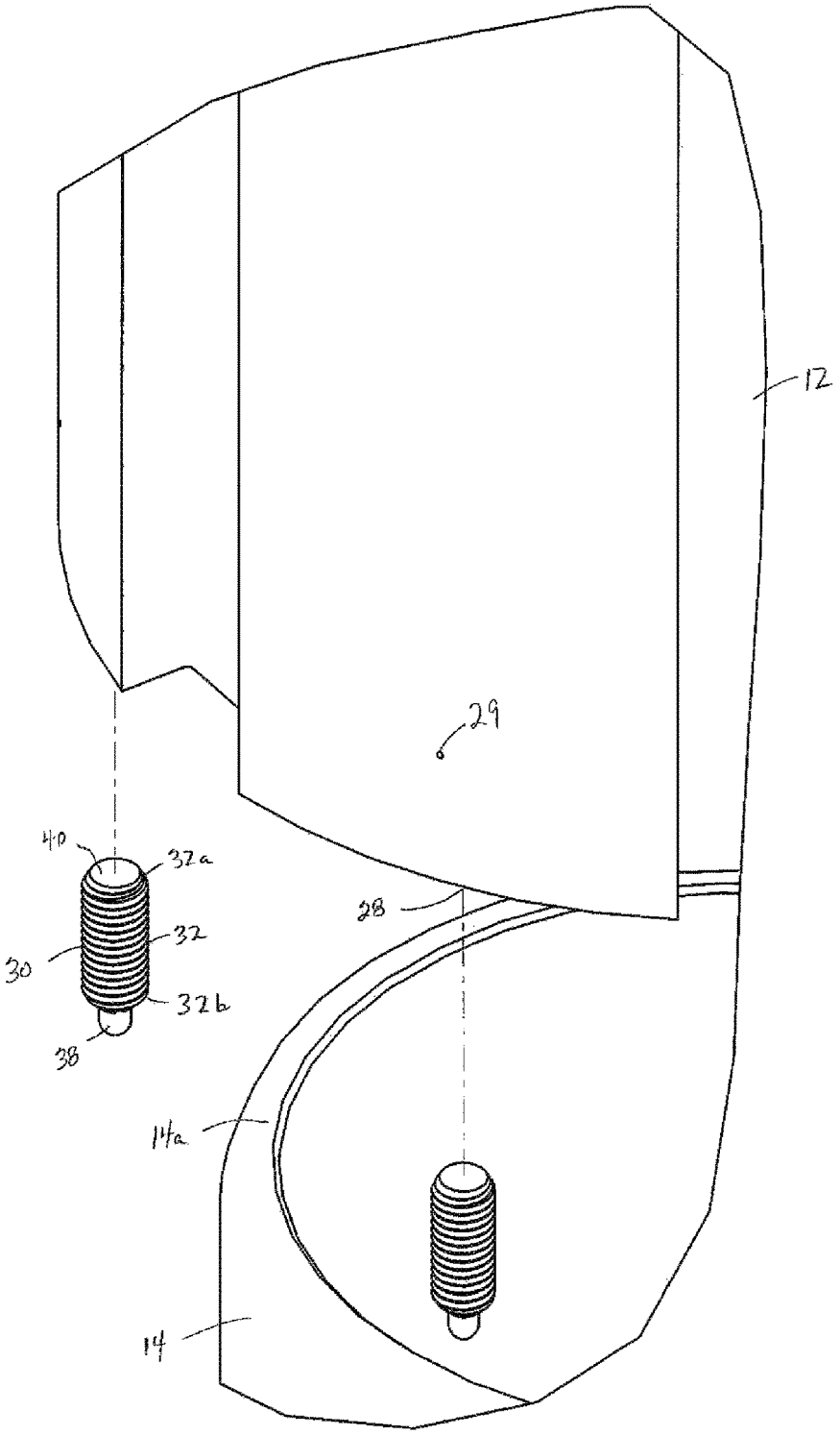
FIG. 3 is an enlarged view of the lower end portion of the running tool of FIG. 1, showing a retractable pin assembly including a retracting pin in a threaded housing to be threaded in vertical threaded ports of the running tool to provide a spring biassed locking pin connection between the running tool and the mandrel casing hanger.
Figure 4:
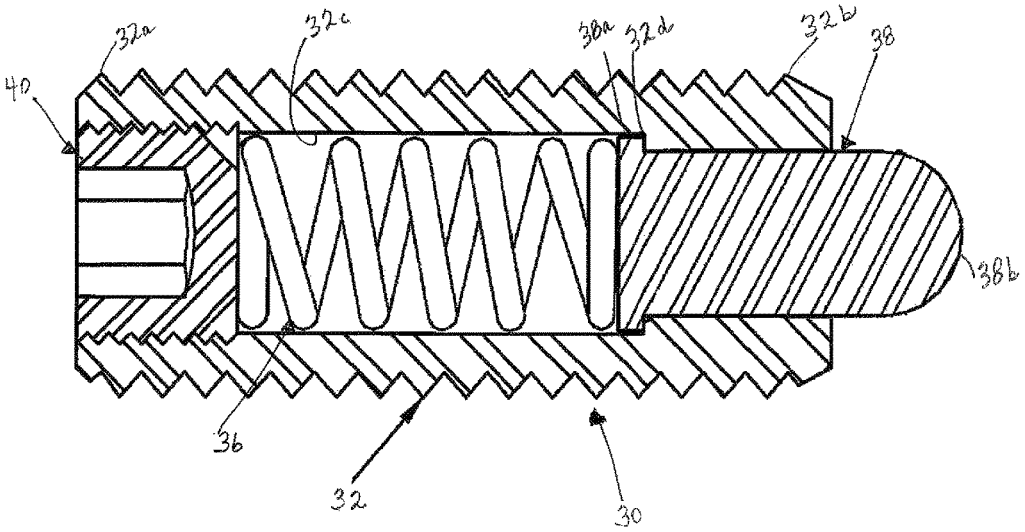
FIG. 4 is a sectional view of a retractable pin assembly of FIGS. 1-3.
Figure 5:
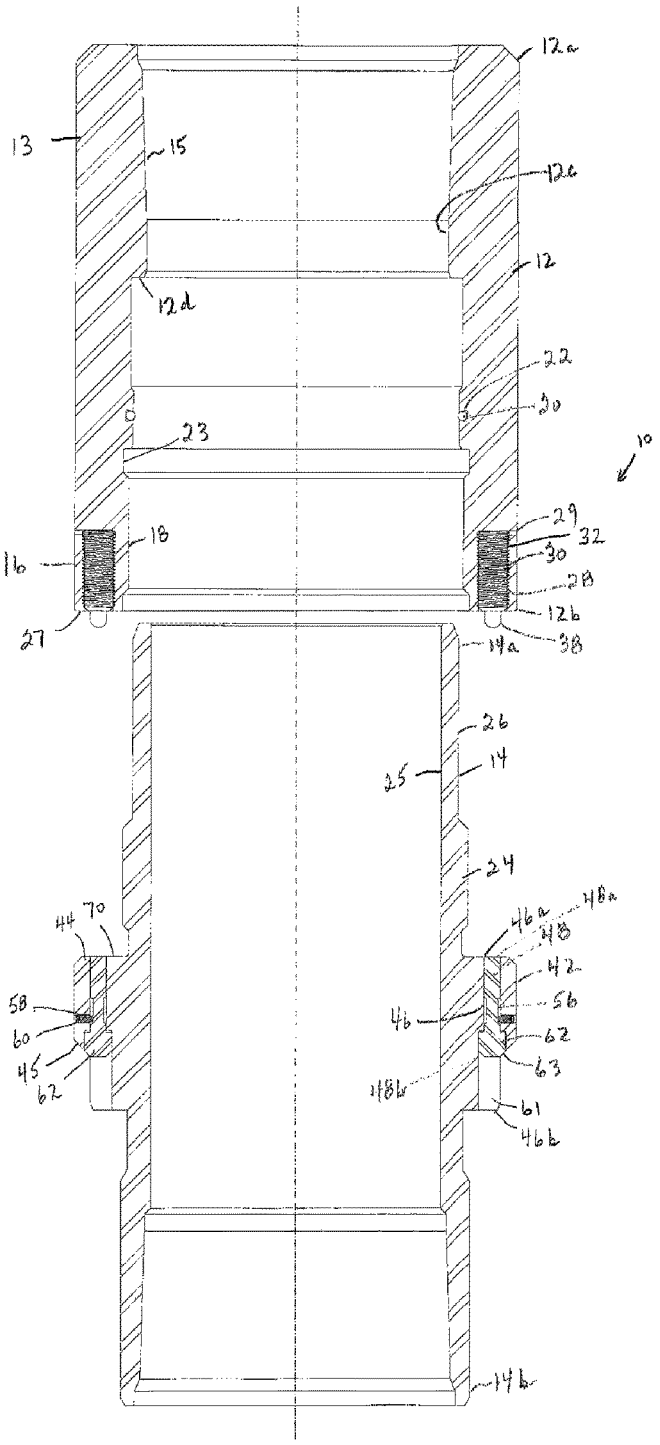
Figure 6:
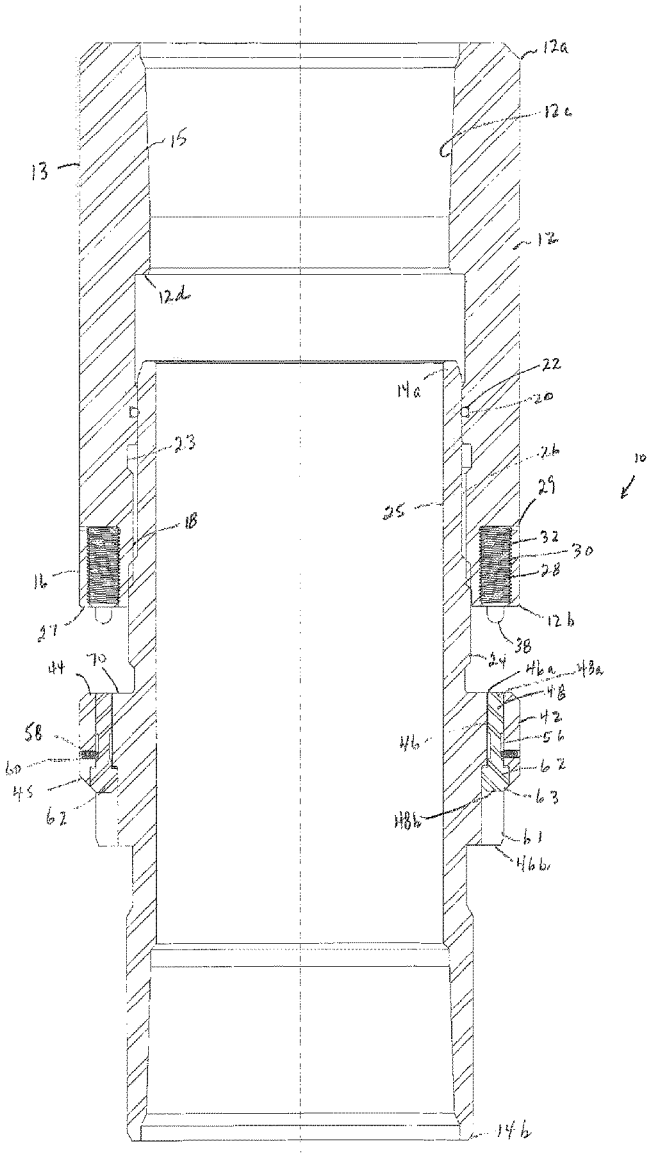
Figure 7:
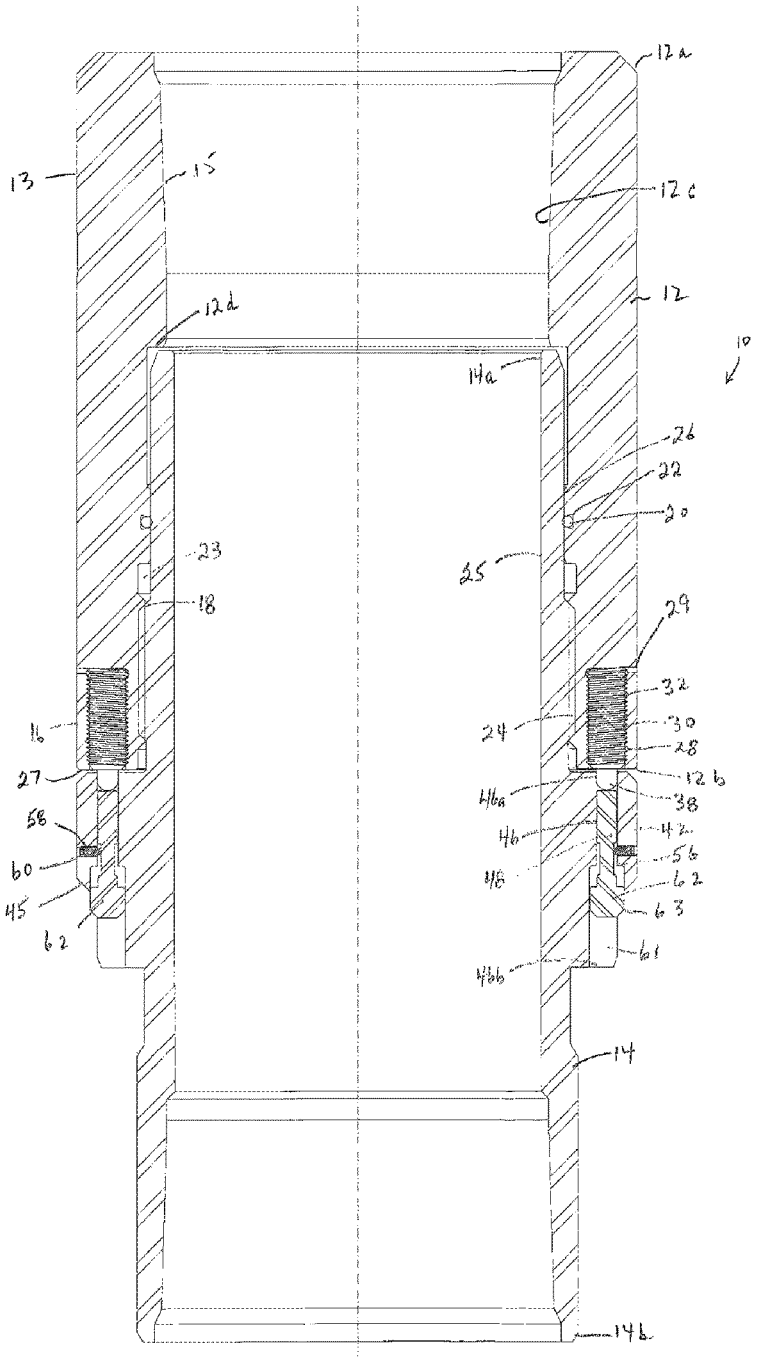
Figure 8:
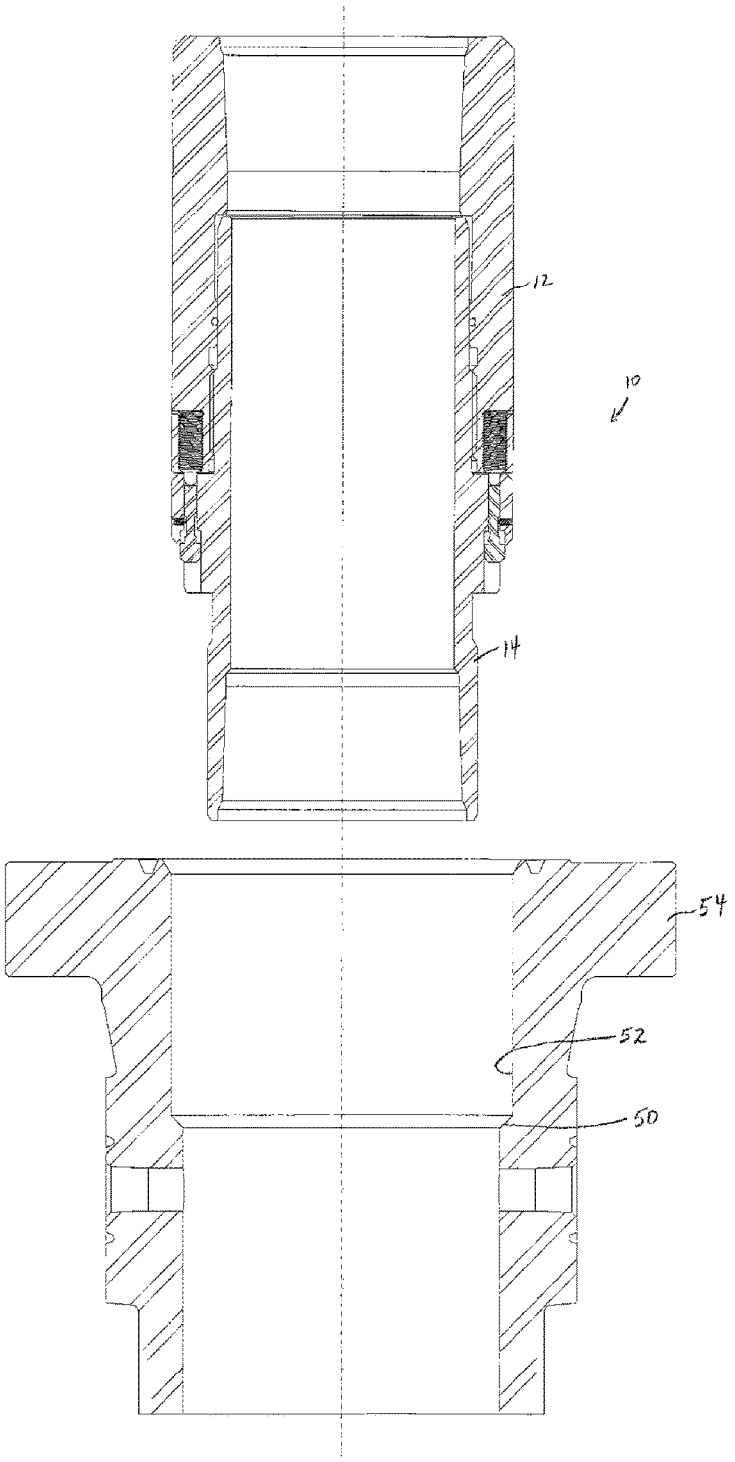
Figure 9:
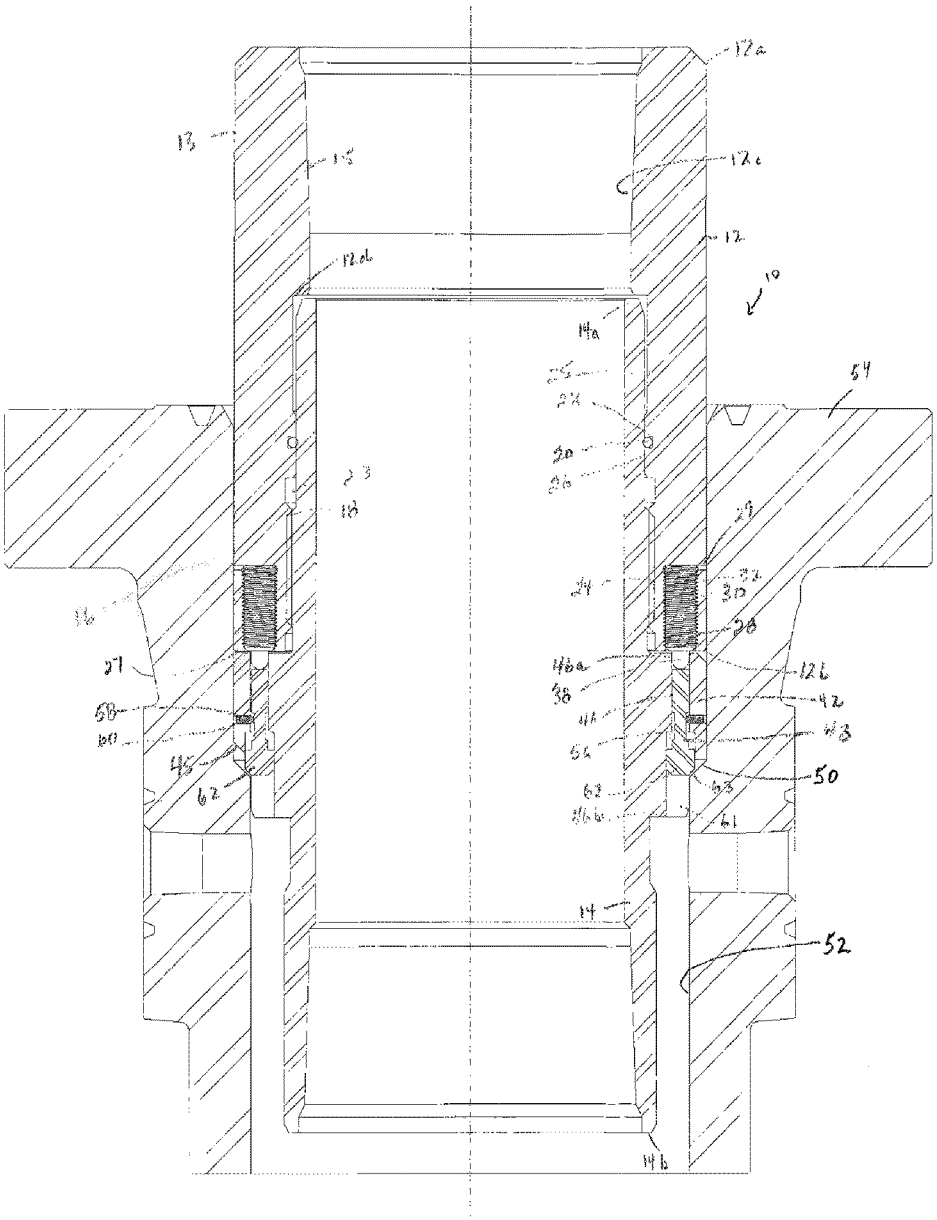
Figure 10:
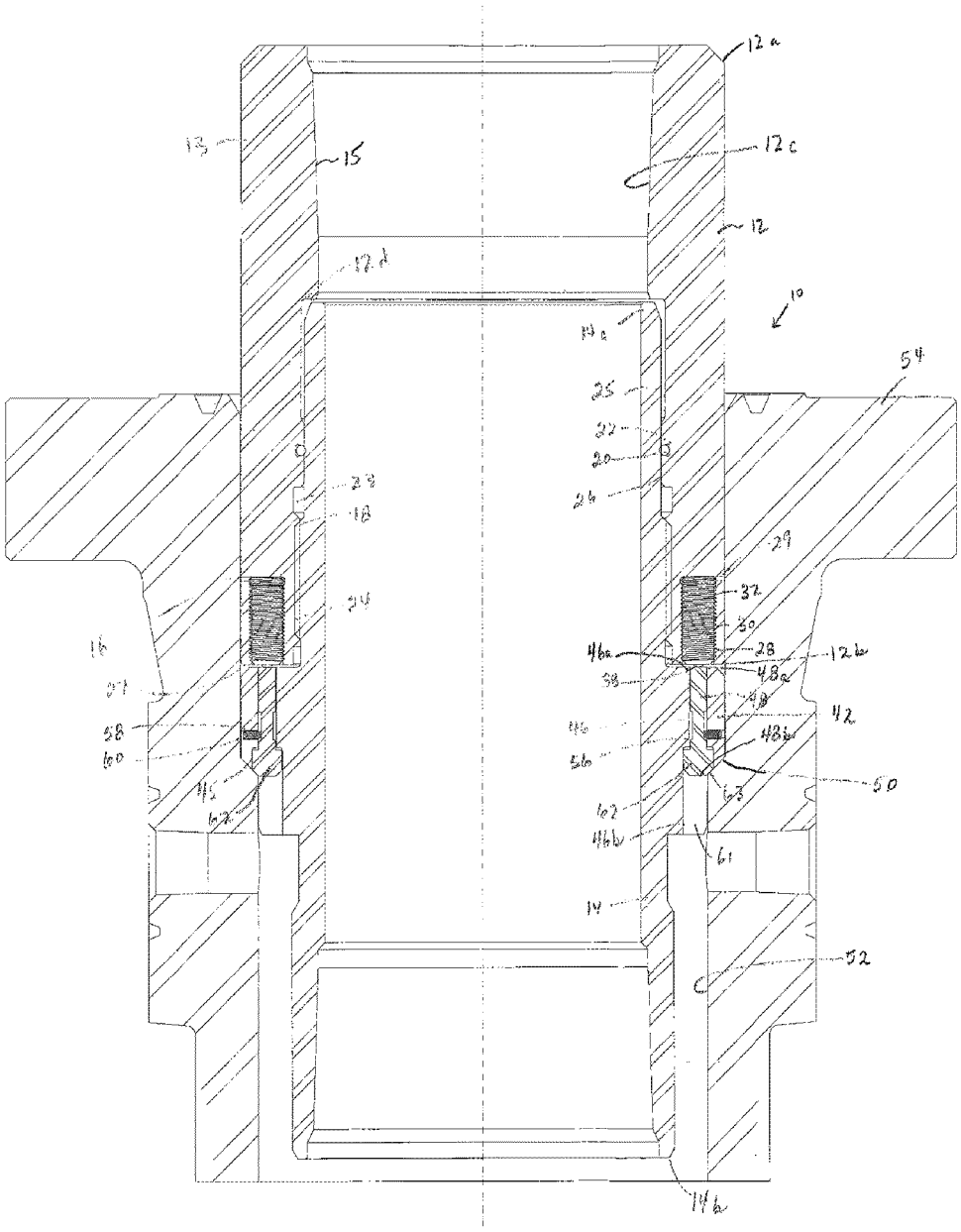
Figure 11:
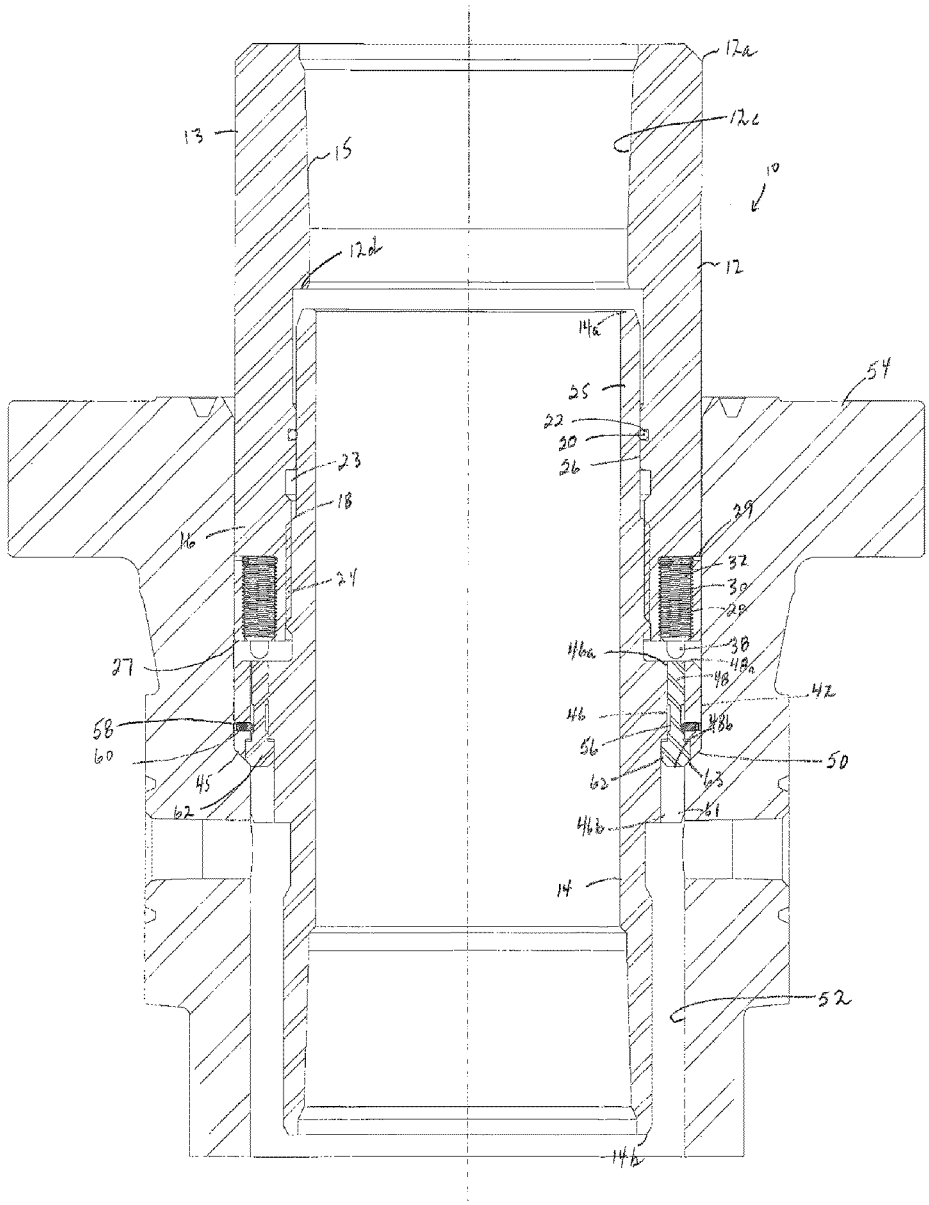
Figure 12:
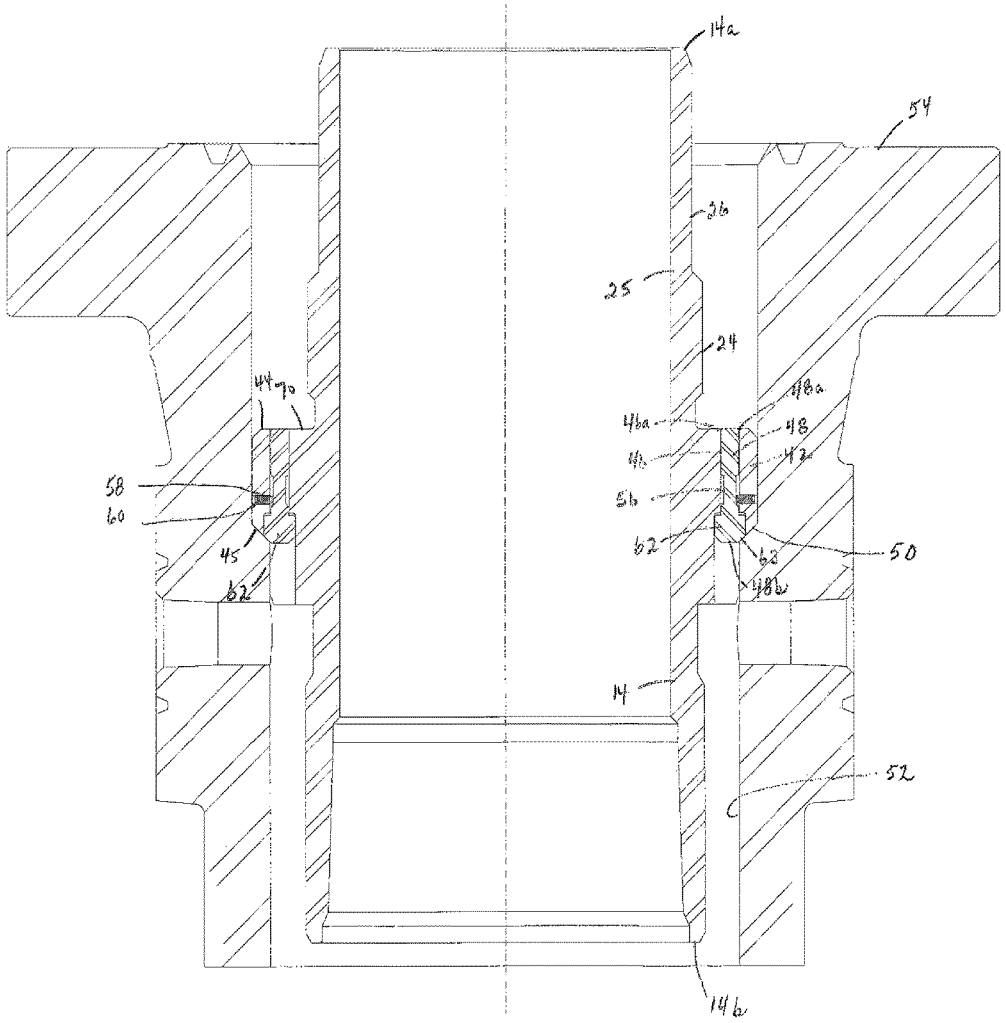
Figure 14:
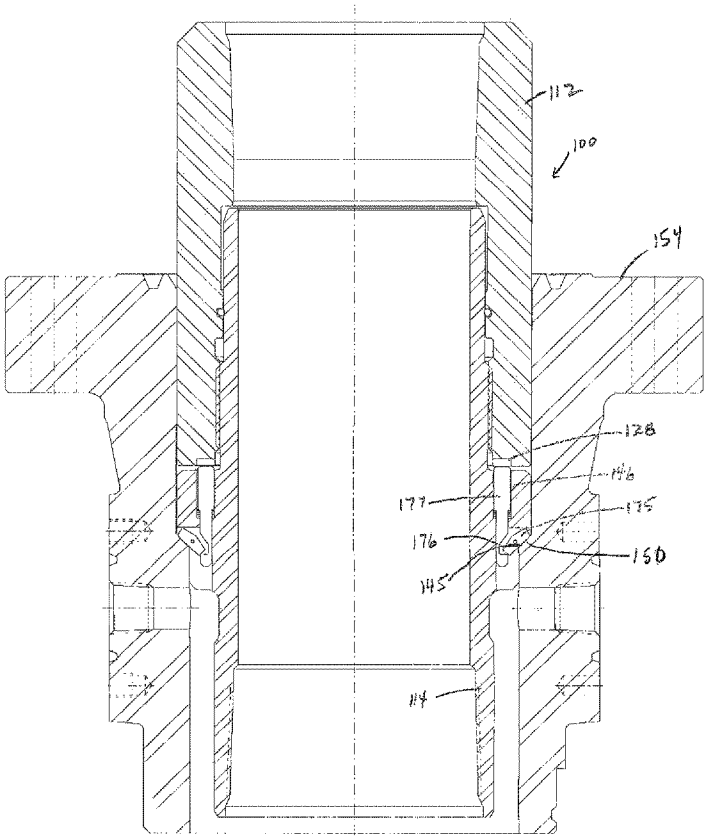

FIG. 14 is a side sectional view of the system of FIG. 13, landed in the casing head with the load shoulder of the casing head engaging the latch to rotate the latch and to pull the spring biassed locking pin downwardly to unlock the locked connection between the running tool and the casing hanger.

Figure 15:
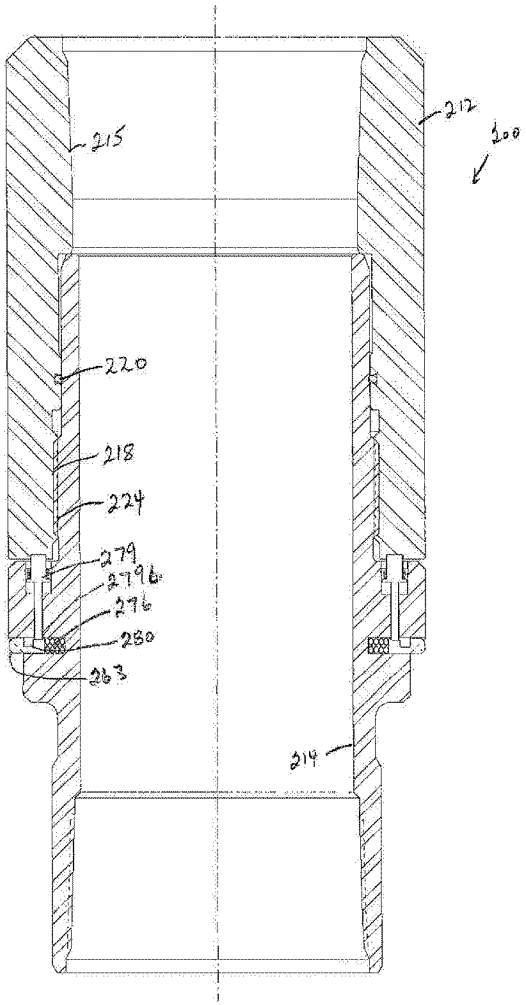

FIG. 15 is a side sectional view of a third embodiment of the torque tool system in which a spring biassed side pin is used hold the base of a spring biassed locking pin in the locking connection of the running tool and the mandrel casing hanger.

Figure 16:
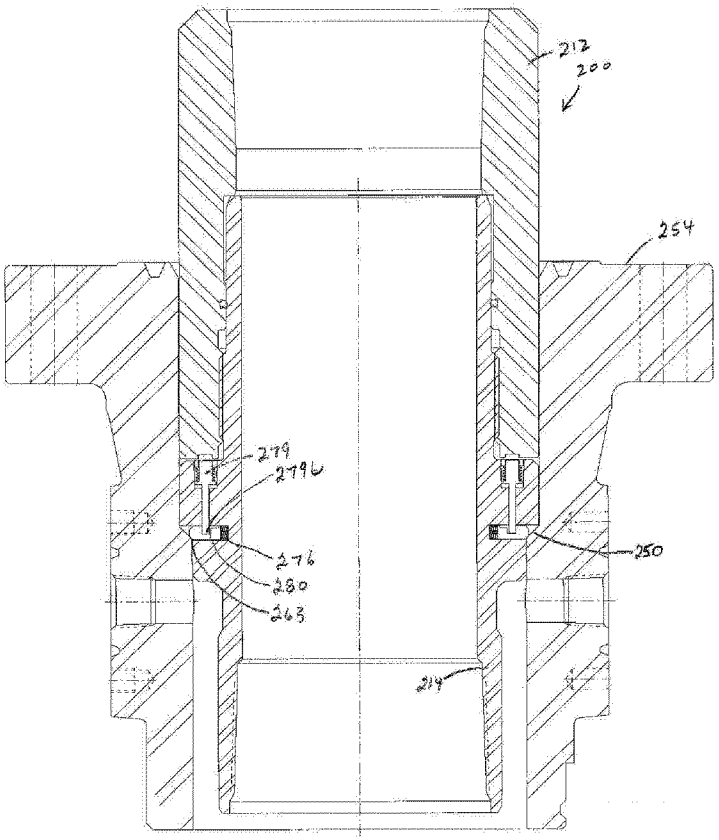

FIG. 16 is a side sectional view of the system of FIG. 15, landed in the casing head with the load shoulder of the casing head engaging the side pin to move the locking pin downwardly to unlock the locked connection between the running tool and the casing hanger.

Figure 17:
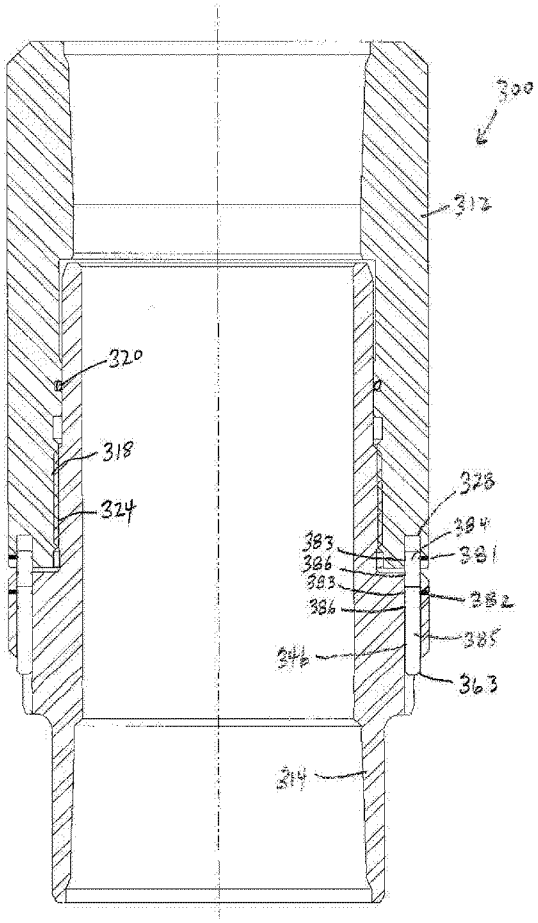

FIG. 17 is a side sectional view of a fourth embodiment of the torque tool system in which spring plungers hold upper and lower locking pins in the locking connection of the running tool and the mandrel casing hanger.

Figure 18:
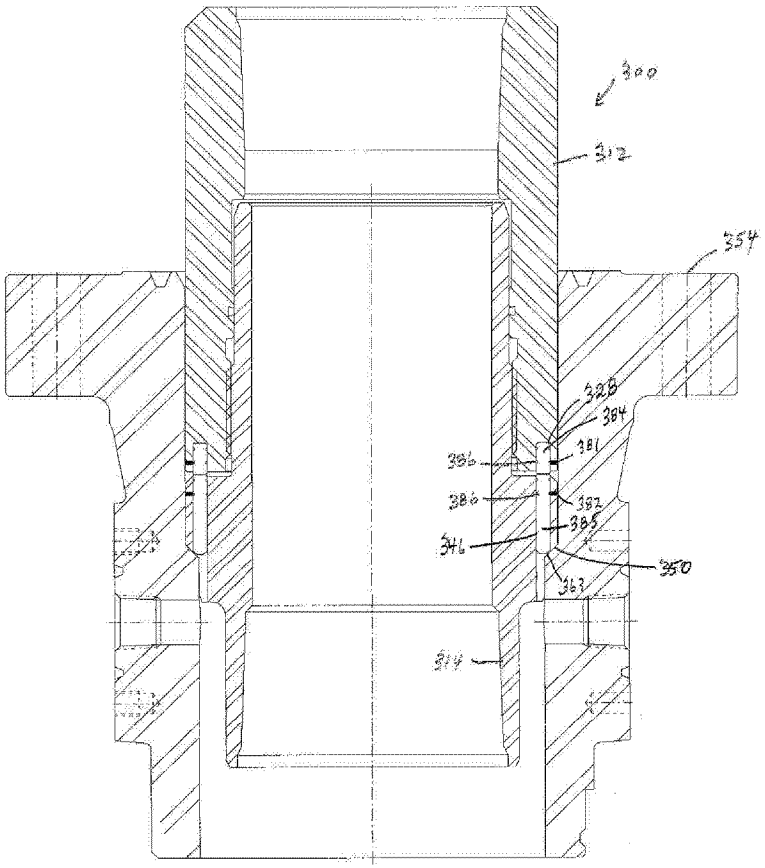

FIG. 18 is a side sectional view of the system of FIG. 17, landed in the casing head with the load shoulder of the casing head engaging the contact shoulder of the lower pin to move the upper and lower pins upwardly against the biassed spring plungers to unlock the locked connection between the running tool and the casing hanger.

Figure 19:
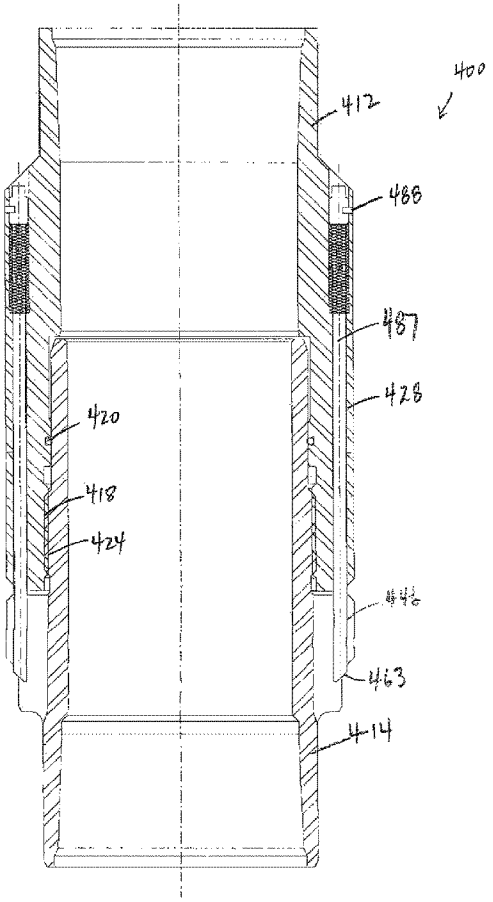

FIG. 19 is a side section view of a fifth embodiment of the torque tool system in which spring biassed vertical locking pins held with shear pins provide the locking connection of the running tool and the mandrel casing hanger.

Figure 20:
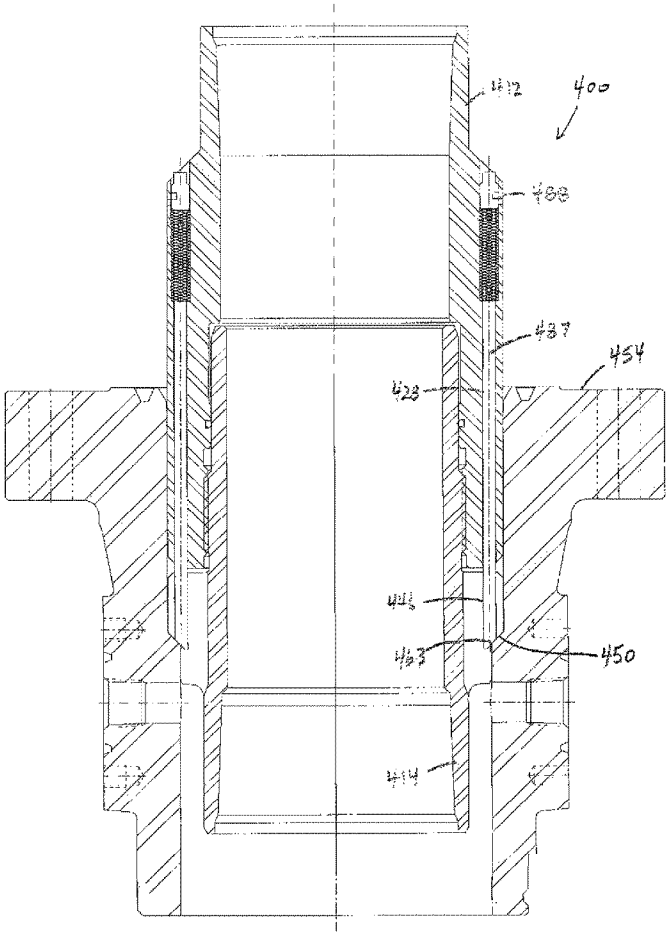

FIG. 20 is a side sectional view of the system of FIG. 19, landed in the casing head with the load shoulder of the casing head engaging contact shoulder of the spring biassed locking pins to shear the shear pins and to move the locking pins upwardly to unlock the locked connection of the running tool and the mandrel casing hanger.

Figure 21:
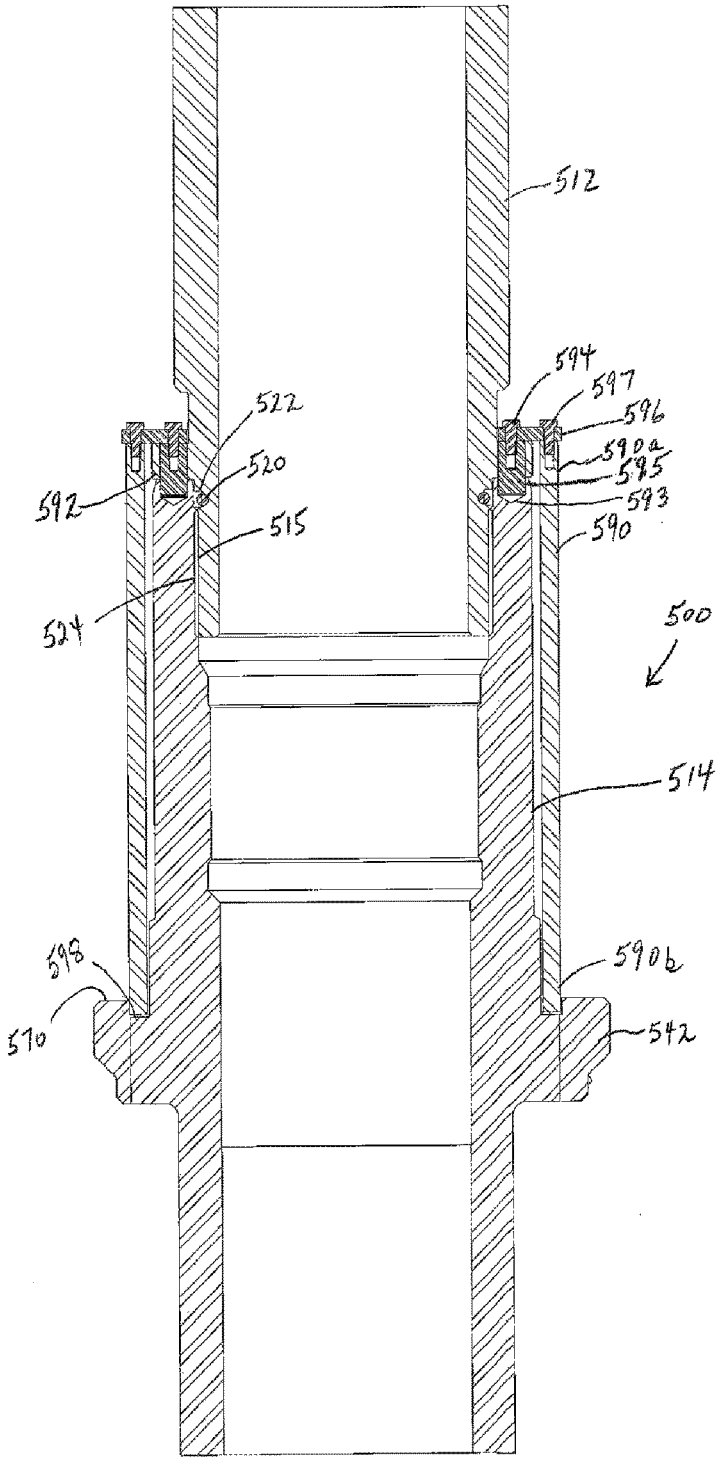
Figure 22:
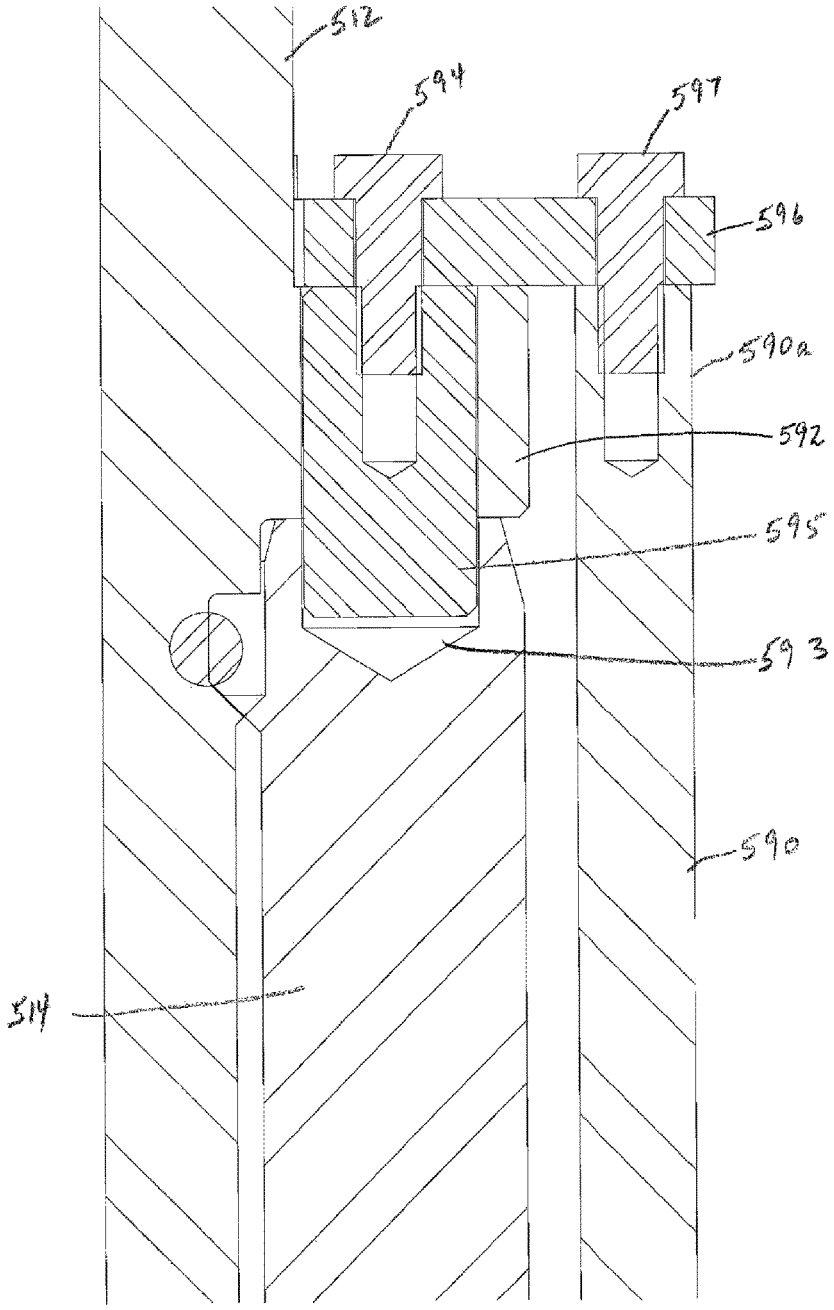
Figure 23:
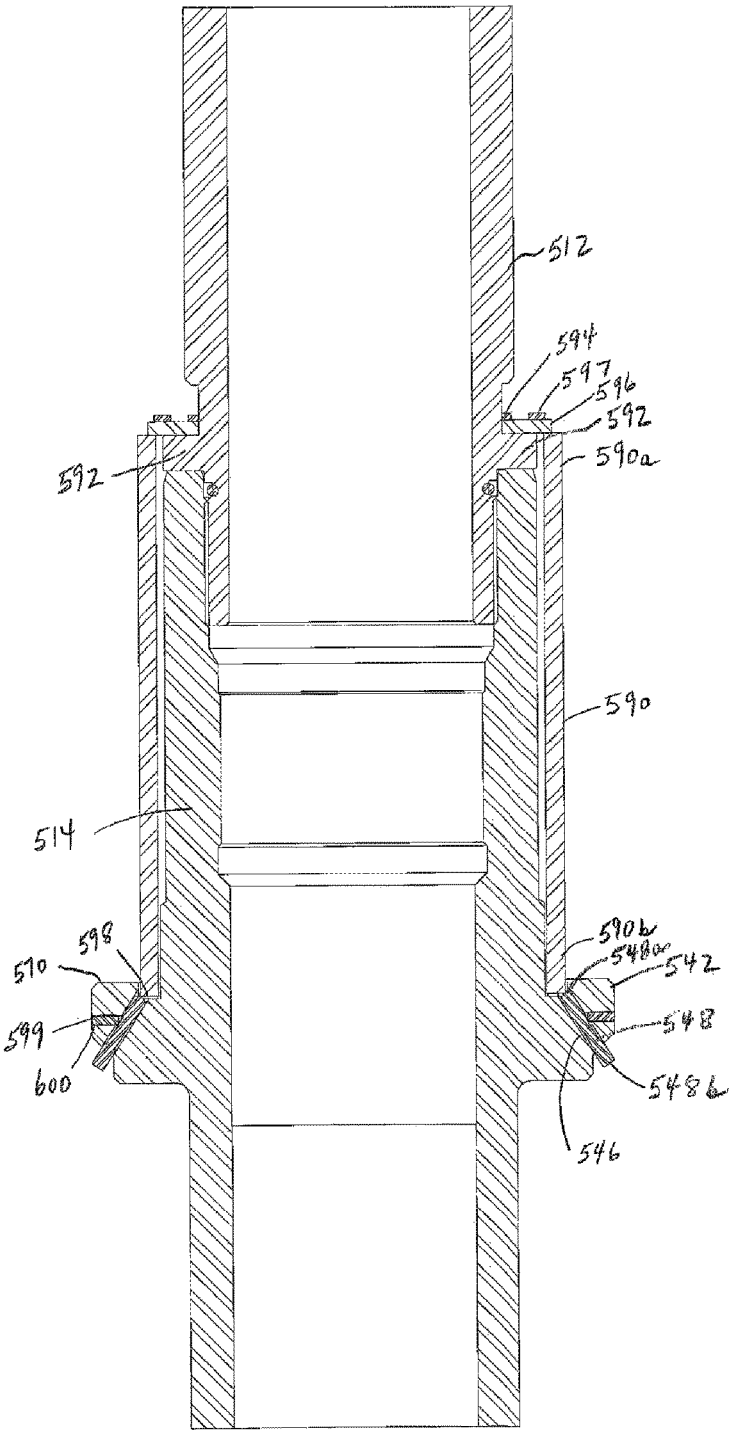

FIGS. 21-23 are side sectional views of a further embodiment of a torque tool system for a mandrel casing hanger, showing a threaded connection to inner threads of the casing hanger by an inner running tool, in which an outer locking tubular is used to provide a locking connection between the running tool and the casing hanger to rotate the casing string. FIGS. 21-23 show the details for connecting the inner running tool and the outer locking tubular to the mandrel casing hanger, locking them together, and using shoulder pins through the support shoulder portion of the casing hanger to contact the load shoulder of the casing head on landing to push generally upwardly on the outer locking tubular to unlock the locking connection between the running tool and the casing hanger and allow the running tool and the casing hanger to be disengaged. The casing head and load shoulder details are generally as shown in FIGS. 1-20, so are omitted for FIGS. 21-23.

DETAILED DESCRIPTION OF THE INVENTION

One exemplary embodiment of the torque tool system 10 is shown in FIGS. 1-4, and a sequence for engaging, locking, unlocking and disengaging is shown in FIGS. 5-12. Further embodiments of exemplary torque tool systems 100, 200, 300, 400 and 500 respectively are shown in FIGS. 13-23. In FIGS. 1-20, the running tool of each of the torque tool systems 10, 100, 200, 300 and 400 is shown to be of a type to connect to the external running threads on a neck of a mandrel casing hanger, while in FIGS. 21-23, the running tool of the torque tool system 500 is shown to be of a type to connect to the internal running threads in a neck of a mandrel casing hanger.

While the torque tool systems are shown herein for rotating a casing string connected to a mandrel casing hanger, it should be understood that the system has broader application. For example, the torque tool system may be applied to rotating other tubular strings such as a tubing string, connected to a tubing hanger. The system also has broad application to locking together a running tool and a tubular member to rotate the tubular member, whether in a wellhead or a downhole tool application. The exemplary embodiments of the Figures show wellhead applications to rotate a casing string, but the system also has application to rotating downhole tools, for example when setting anchors, liner hangers and other downhole equipment in the casing.

As well, while the Figures show systems relating to a threaded connection between a running tool and a mandrel casing hanger, the system extends to other mechanical connections between a running tool on the one hand and a tubular member, such as a mandrel casing hanger, on the other hand. For example, alternate mechanical connections may include j-latch, collet, locking pins, locking dogs, and push/pull connections to engage the running tool to the tubular member.

Still further, while the Figures show systems relating to landing a mandrel casing hanger on a load shoulder in a casing head to unlock a locking mechanism between the hanger and the running tool, the system extends to other landing mechanisms for landing a tubular member to unlock the locking assembly, for example landing lugs, support shoulders, load shoulders, no go shoulders, and locking dogs.

In general, in the embodiments of the Figures, the torque tool system engages and locks a running tool with a mandrel casing hanger to allow the mandrel casing hanger to be reciprocated longitudinally (upwardly and downwardly), while being rotated in either or both of a clockwise direction and a counter-clockwise direction under high torque conditions, without translating the torque to the running thread on the mandrel casing hanger. A locking assembly, for example retractable pins, engages between the running tool and an outer support shoulder of the casing mandrel hanger to allow the threaded connection between the mandrel casing hanger and running tool to be made up. When the locking assembly, such as the retractable pins, is engaged in the locked position, the mandrel casing hanger and running tool are locked together and rotate synchronously as one body. The casing string weight is supported by the running threads, and the torque of rotating the casing string is transferred through the locking assembly, such as the retractable pins, to the mandrel casing hanger. However, once the mandrel casing hanger is landed in an outer tubular member such as a casing head, the locking assembly is unlocked, allowing the running tool and mandrel casing hanger to be disengaged under low torque conditions.

In many of the prior art devices, the mandrel casing hanger is connected to a running tool so as to only be rotatable in one direction, with the opposite direction being used to disengage connecting pins between the tool and hanger. The pins of some prior art devices are angled on one side to be disengaged when rotated in the specified opposite direction. The torque tool system and method of this invention does not rely on reverse rotation to disengage a locking assembly or locking pins, but instead uses the force of landing the mandrel casing hanger onto a load shoulder of an outer tubular member, to cause components of a locking assembly to unlock the locking connection between the running tool and the casing hanger, to permit the running tool and the casing hanger to be disengaged under low torque conditions.

Turning to an exemplary embodiment of FIGS. 1-12, the torque tool system 10 is shown to include a joint or body of a running tool 12 for threaded connection to a mandrel casing hanger 14. The running tool 12 forms an internal bore 12*c* between its upper and lower ends 12*a*, 12*b*. The internal bore 12*c* of the running tool 12 has a female casing threaded top connection 13 forming internal threads 15, and a female thread bottom connection 16 to provide internal running threads 18, an o-ring seal 20 held in a dovetail seal groove 22 above the internal threads 18, and an enlarged diameter thread relief section 23 above the threads 18 and below the seal 20. The running threads 18 engage the external running threads 24 on the threaded neck portion 25 at the upper portion of the casing hanger 14, while the o-ring seal 20 of the running tool 12 seals to the slick neck portion 26 of the casing hanger 14 above the threaded neck portion 25. The internal bore 12*c* of the running tool 12 forms an inwardly protruding shoulder 12*d* to engage the top end 14*a* of the casing hanger 14. The lower portion of the casing hanger 14 is adapted, for example with threads, to suspend a tubular string such as a casing string, as is well known in the art.

The bottom face 27 of the running tool 12 is formed with a plurality of circumferentially spaced threaded vertical ports or recesses 28, into each of which is threaded a retractable pin assembly 30. A weep hole 29 extends through the wall of the running tool body 12 to the top of each of the vertical ports 28. One embodiment of the retractable pin assembly 30, best shown in FIG. 4, includes an outer threaded housing 32, which houses in its internal bore 32*c*, a return spring 36 and a retracting pin 38. The retracting pin 38 is held at its upper end 38*a* by an internal shoulder 32*d* of the housing bore 32*c* and protrudes from the lower end of the housing 32*b*. A threaded retaining nut 40 is threaded into the upper end 32*a* of the housing bore 32*c* to hold the spring 36 and pin 38 in place.

The mandrel casing hanger 14 includes an outwardly extending support shoulder portion 42 between its ends 14*a*, 14*b* and below the threads 24, to form an outwardly extending and upwardly facing base 44, against which the bottom face 27 of the running tool 12 stops when the tool and hanger 12, 14 are threaded together. The lower surface portion of the support shoulder portion 42 forms a tapered landing shoulder 45 to engage and mate with an inwardly protruding load shoulder 50 formed in the inner bore 52 of the casing head 54 when the casing hanger 14 is seated and landed in the casing head 54. The support shoulder portion 42 of the casing hanger 14 is formed with a plurality of vertical ports 46 extending generally vertically there through as through holes. The ports 46 are arranged to align with the threaded vertical ports 28 of the running tool 12 such that, when the running tool 12 and casing hanger 14 are turned to vertically align the ports 28, 46, each of the downwardly protruding retracting pins 38 of the running tool 12 extends a short distance into the upper end 46*a* of the vertical port 46 of the casing hanger 14 when the running tool 12 and the casing hanger 14 are threaded together. When the retracting pins 38 of the running tool 12 are held in the ports 46 of casing hanger 14, the two components 12, 14 are locked together such that both components 12, 14, and the casing string coupled to the casing hanger 14, may be synchronously rotated clockwise or counterclockwise in this locked and connected state.

A shoulder pin 48 is held in each of the vertical ports 46 of the casing hanger 14. The shoulder pin 48 is formed with a reduced diameter section 56 between its upper and lower ends 48*a*, 48*b*. A set screw 58 extends through threaded side ports 60 in the support shoulder portion 42 of the casing hanger 14 to intersect the port 46 and to meet the reduced diameter section 56 of the shoulder pin 48 to hold the pin 48 from falling downwardly out of the ports 46, while allowing the pin 48 to be moved upwardly and downwardly within the port 46 by a distance equal to the height of the reduced diameter section 56. The lower end portion 48*b* of the shoulder pin 48 is formed with an enlarged head 62 which is tapered on its lower and outer surface to form a contact shoulder 63 to engage and mate with the load shoulder 50 of the casing head 54. The vertical ports 46 are each similarly enlarged at their lower end 46*b* to form an enlarged and outwardly opened fluted bore portion 61 to accommodate the enlarged head 62 of the shoulder pin 48. When the lower contact shoulder 63 of the enlarged head 62 of the shoulder pin 48 contacts the load shoulder 50 of the casing head 54, the shoulder pin 48 is moved vertically upwardly within the vertical ports 46 to push the retracting pins 38 vertically upwardly and out of the vertical ports 46 of the casing hanger 14, and to thereby unlock the connection between the casing head 14 and the running tool 12. This unlocking allows the running tool 12 to be reverse rotated (i.e., reverse threaded) to disengage the threaded connection between the components 12, 14.

The support shoulder portion 42 of the casing hanger 14 may be formed with vertical cut-away portions 66 between the ported sections 68 to allow for fluid communication through the system 10. The upper face 70 of the base 44 may be tapered at sections 67 of the cut-away portions 66, to allow the retracting pins 38 to ride smoothly upwardly onto the upper face 70 as the components 12, 14 are threaded together and as the ports 28, 46 are brought into vertical alignment. The lower engaging surface of the retracting pins 38 may be rounded to ride smoothly on the face 70 and for engaging into the vertical ports 46 for the locking connection.

While the load shoulder 50 of the casing head 54 is shown to be formed integral to the casing head 54 as a feature of the profile of the inner bore 52, it will be understood that a separate or different type of load shoulder component may be used in the casing head 54, as is known in the art.

In the embodiment described above, the features of the retractable pin assembly 30, the shoulder pins 48, and the set screws 58 co-operate with the ports 28, 46, 60 of the running tool 12 and casing hanger 14 to provide one exemplary embodiment of a locking assembly adapted to lock the casing hanger 14 and running tool 12 together once the hanger and tool 14, 12 are threaded together (or otherwise mechanically connected) so that torque applied to the running tool 12 is applied to the hanger 14 through the locking assembly to rotate the running tool 12, the hanger 14 and the casing string synchronously in either direction, and to unlock the hanger 14 and the running tool 12 when the hanger 14 is landed on a load shoulder 50 of a casing head 54 so that the threaded connection can be reversed.

Operation of Torque Tool System

The operating procedure for assembling the running tool 12 and the mandrel casing hanger 14, for locking the components 12, 14 together with the retracting pins 38, and for landing the mandrel casing hanger 14 in the casing head 54 to unlock and disengage the components 12, 14 is shown in sequence in FIGS. 5-12, and is briefly described below.

Step 1—A casing string is threaded to casing threads at a lower portion of the casing hanger 14, or is otherwise connected to the casing hanger in a manner known in the art. Before installing the running tool 12 on the mandrel casing hanger 14, the retracting pins 38 are fully cycled to ensure the springs 36 are functioning properly. The shoulder pins 48, which act as floating pistons, are secured on the mandrel casing hanger 14 in the up position with the set screws 58.

Step 2—The running tool 12 is threaded onto the mandrel casing hanger 14 until the running tool 12 is stopped by contacting the support shoulder portion 42 of the casing hanger 14. The set screws 58 are disengaged from the shoulder pins 48 by rotating them, for example ½ turn counter-clockwise, to allow the shoulder pins 48 to lower.

Step 3—The running tool 12 is reverse rotated until the energized retracting pins 38 and shoulder pins 48 are aligned, and the retaining pins 38 drop into the vertical ports 46 to lock the running tool 12 on the hanger 14.

Step 4—Once engaged and locked together, torque applied to the running tool 12 is applied to the casing hanger 14 through the retaining pins 38 to rotate the running tool 12, the mandrel hanger 14 and the casing string synchronously in clockwise or counter-clockwise direction as needed, while the running tool 12 and the casing hanger 14 is longitudinally raised or lowered (reciprocated).

Step 5—The landing shoulder 45 of the casing hanger 14 is landed onto the load shoulder 50 of the casing head 54 to unlock the components 12, 14, as described above, as the shoulder pins 48 engage the load shoulder 50 and are driven upwardly to dislodge the retracing pins 38 from the vertical ports 46.

Step 6—The running tool 12 can then be rotated in a reverse direction, i.e., reverse threaded, to disengage and remove it from the casing hanger 14. The running tool 12 can be checked for damage before re-use.

In some embodiments, the torque tool system may provide one or more of the following advantages:

1. The threaded connection between the running tool 12 and hanger 14 is isolated from torque applied to the casing string as the casing string is rotated in either direction (clock-wise/counter-clockwise).
2. The running tool 12 may be disengaged once the casing hanger 14 is landed in the casing head 54 without the reverse rotation procedure used in the prior art.
3. Low maintenance.
4. Safe and easy operation.
5. Retrievable and can be re-installed.

Further exemplary embodiments of torque tool systems with alternate locking assemblies are shown in FIGS. 13-23, and are briefly described below. In the embodiments 100, 200, 300, 400 and 500 of FIGS. 13-23, features which are the same or similar to the features of the embodiment of FIGS. 1-12 are either not labelled, or are illustrated with like reference numerals to the reference numerals for FIGS. 1-12, but which are increased by 100 (FIGS. 13, 14), 200 (FIGS. 15, 16), 300 (FIGS. 17, 18), 400 (FIG. 19, 20) or 500 (FIGS. 21-23).

FIGS. 13 and 14 show a second embodiment of a torque tool system 100 in which the locking assembly between the running tool 112 and the casing hanger 114 includes a latch 175, pivotally connected at the tapered landing shoulder 145 of the casing hanger 114. The latch 175 holds the notched base 176 of an upwardly spring biassed locking pin 177 in a locking connection within the aligned vertical ports 128, 146 of the running tool 112 and casing hanger 114 respectively. FIG. 14 shows the system 100 landed on the load shoulder 150 of the casing head 154, with the load shoulder 150 engaging the latch 175 to rotate the latch 175 and to pull pin 177 downwardly out of the ports 128 of the running tool 112, to unlock the locked connection between the running tool 112 and the casing hanger 114.

FIGS. 15 and 16 show a third embodiment of the torque tool system 200 in which a spring biassed side pin 278 is used hold the base of a spring biassed locking pin 279 in a locking connection of the running tool 212 and the mandrel casing hanger 214. The side pin 278 is formed with a tapered outer contact shoulder 263 to engage and mate with the load shoulder 250 of the casing head 254. FIG. 16 shows the system 200 landed in the casing head 254 with the load shoulder 250 engaging the contact shoulder 263 of the side pin 278 to move the side pin 278 inwardly, causing the lower end 279*b* of the locking pin 279 to move downwardly into a notch 280 in the side pin 278 to unlock the locked connection between the running tool 212 and the casing hanger 214.

FIGS. 17 and 18 show a torque tool system 300 in which spring plungers 381, 382 engage in upper pin grooves 383 to hold upper and lower locking pins 384, 385 in vertically aligned ports 328, 346 of the running tool 312 and the casing hanger 314 respectively, to provide a locking connection of the running tool 312 and the mandrel casing hanger 314. FIG. 18 shows the system 300 landed in the casing head 354 with the load shoulder 350 engaging the tapered outer contact shoulder 363 of the lower pin 385. This landing step moves the pins 384, 384 upwardly in ports 328, 346 so that the spring plungers 381, 382 engage lower pin grooves 386 of the pins 384, 385, and to unlock the locked connection between the running tool 312 and the casing hanger 314.

FIGS. 19 and 20 show a torque tool system 400 in which spring, upwardly biassed vertical locking pins 487 are held with shear pins 488 between the vertically aligned ports 428, 446 of the running tool 412 and the casing hanger 414 respectively to provide the locking assembly to lock together the running tool 412 and the mandrel casing hanger 414. FIG. 20 shows the system 400 landed in the casing head 454 with the load shoulder 450 engaging the lower tapered contact shoulder 463 of the spring biassed locking pins 487 to shear the shear pins 488, allowing the spring biassed locking pins 487 to move upwardly out of the casing hanger ports 446 to unlock the locked connection of the running tool 412 and the mandrel casing hanger 414.

FIGS. 21-23 are side sectional views of a further embodiment of a torque tool system 500 showing an internal threaded connection between inner running threads 524 of a mandrel casing hanger 514 and outer threads 515 of an inner running tool 512. An o-ring seal 520 is located in a dovetail groove 522 formed in the inner running tool 512 above the threads 515. An outer locking tubular 590 is used to provide a locking connection between a support portion 592 of the running tool 512 and a support shoulder portion 542 of the casing hanger 514, such that torque applied to the running tool 512 is applied through the outer locking tubular 590 to the casing hanger 514 to rotate a casing string. The outwardly extending connecting portion 592 of the running tool 512 is connected to ports 593 in the upper end of the casing hanger 514 with threaded members 594, 595 and extension plates 596. The upper end 590*a* of the outer locking tubular 590 is connected to the extension plates 596 with pins 597. The lower end 590*b* of the outer locking tubular 590 is held in a circumferential groove 598 formed in the upper face 570 of the support shoulder portion 542 of the casing hanger 514 to lock the running tool 512 and the casing hanger 514 together. Shoulder pins 548 (FIG. 23) extend through ports 546 in the support shoulder portion 542 of the casing hanger 514 such that the upper ends 548*a* of the pins 548 contact the lower end 590*b* of the outer locking tubular 590. The shoulder pins 548 are held with horizontal set screws 599 extending through ports 600 the support shoulder portion 542 of the casing hanger 514. On landing in the casing head, the lower end 548*b* of the shoulder pins 548 contact the load shoulder of the casing head to push generally upwardly on the lower end 590*b* of the outer locking tubular 590 to unlock the locking connection between the running tool 512 and the casing hanger 514, allowing the running tool 512 and the casing hanger 514 to be disengaged by reverse threading. The casing head and landing shoulder details are generally as shown in FIGS. 1-20, so are not shown for FIGS. 21-23.

As used herein and in the claims, the word "comprising" is used in its non-limiting sense to mean that items following the word in the sentence are included and that items not specifically mentioned are not excluded. The use of the indefinite article "a" in the claims before an element means that one of the elements is specified, but does not specifically exclude others of the elements being present, unless the context clearly requires that there be one and only one of the elements.

All references mentioned in this specification are indicative of the level of skill in the art of this invention. All references are herein incorporated by reference in their entirety to the same extent as if each reference was specifically and individually indicated to be incorporated by reference. However, if any inconsistency arises between a cited reference and the present disclosure, the present disclosure takes precedence. Some references provided herein are incorporated by reference herein to provide details concerning the state of the art prior to the filing of this application, other references may be cited to provide additional or alternative device elements, additional or alternative materials, additional or alternative methods of analysis or application of the invention.

The terms and expressions used are, unless otherwise defined herein, used as terms of description and not limitation. There is no intention, in using such terms and expressions, of excluding equivalents of the features illustrated and described, it being recognized that the scope of the invention is defined and limited only by the claims which follow. Although the description herein contains many specifics, these should not be construed as limiting the scope of the invention, but as merely providing illustrations of some of the embodiments of the invention.

One of ordinary skill in the art will appreciate that elements and materials other than those specifically exemplified can be employed in the practice of the invention without resort to undue experimentation. All art-known functional equivalents, of any such elements and materials are intended to be included in this invention. The invention illustratively described herein suitably may be practised in the absence of any element or elements, limitation or limitations which is not specifically disclosed herein.

We claim:

1. A system for locking together a running tool and a tubular member to rotate the tubular member, comprising:

a tubular member;

a running tool adapted to engage in a mechanical connection to the tubular member such that the running tool and the tubular member are arranged concentrically and moveable longitudinally together;

a locking assembly adapted to lock the tubular member and the running tool together once the tubular member and the running tool are engaged in the mechanical connection, so that torque applied to the running tool is applied to the tubular member through the locking assembly to rotate the running tool and the tubular member synchronously in a clockwise direction or a counterclockwise direction; and the locking assembly being adapted to unlock the tubular member and the running tool when the tubular member is landed on a shoulder of an outer tubular member so that the mechanical connection can then be disengaged.

2. The system of claim 1, wherein:

the tubular member is a mandrel hanger formed with one or both of external running threads and internal running threads at an upper portion and being adapted to suspend a tubular string from a lower portion;

the running tool is formed with threads to engage the external running threads or the internal running threads of the mandrel hanger to form the mechanical connection as a threaded connection to the mandrel hanger; and the outer tubular member is a wellhead spool having a load shoulder, such that the locking assembly is adapted to lock the mandrel hanger and the running tool together once the running tool is threaded onto the mandrel hanger so that torque applied to the running tool is applied to the mandrel hanger through the locking assembly to rotate the running tool, the mandrel hanger and the tubular string synchronously in the clockwise direction or the counterclockwise direction, and such that the locking assembly unlocks the mandrel hanger and the running tool when the mandrel hanger is landed on the load shoulder of the wellhead spool so that the threaded connection can be reversed to disengage the running tool from the mandrel hanger.

3. The system of claim 2, wherein the mandrel hanger is a mandrel casing hanger, the tubular string is a casing string, and the wellhead spool is a casing head.

4. A system for locking together a running tool and a mandrel hanger to rotate a tubular string suspended from the mandrel hanger, comprising:

a mandrel hanger adapted to suspend the tubular string from a lower portion, the mandrel hanger being formed with a plurality of circumferentially spaced hanger ports;

a running tool adapted to engage in an external mechanical connection to the mandrel hanger such that the running tool and the mandrel hanger are arranged concentrically and moveable longitudinally together, the running tool being formed with a plurality of circumferentially spaced running tool ports adapted to be aligned with the hanger ports once the running tool and the mandrel hanger are engaged in the mechanical connection;

a locking assembly including locking pins arranged to engage between the aligned hanger ports and running tool ports to lock the mandrel hanger and running tool together once the running tool and the mandrel hanger are engaged in the mechanical connection, so that torque applied to the running tool is applied to the mandrel hanger through the locking pins to rotate the running tool, the mandrel hanger and the tubular string synchronously in a clockwise direction or a counterclockwise direction; and the locking assembly being adapted to move the locking pins generally upwardly or downwardly within one or both of the hanger ports and the running tool ports to unlock the mandrel hanger and the running tool when the mandrel hanger is landed on a load shoulder of a wellhead spool so that the mechanical connection can be then be disengaged.

5. The system of claim 4, wherein:

the mandrel hanger is formed with external running threads formed at an upper portion; and the running tool is formed with threads to engage the external running threads of the mandrel hanger to form the mechanical connection as a threaded connection;

such that the locking assembly is adapted to lock the mandrel hanger and the running tool together once the running tool is threaded onto the external running threads of the mandrel hanger so that torque applied to the running tool is applied to the mandrel hanger through the locking pins to rotate the running tool, the mandrel hanger and the tubular string synchronously in the clockwise direction or the counterclockwise direction, and such that the locking assembly unlocks the mandrel hanger and the running tool when the mandrel hanger is landed on the load shoulder of the wellhead spool so that the threaded connection can be reversed to disengage the running tool from the mandrel hanger.

6. The system of claim 5, wherein the mandrel hanger is a mandrel casing hanger, the tubular string is a casing string, and the wellhead spool is a casing head.

7. The system of claim 4, wherein the mandrel hanger is a mandrel casing hanger, the tubular string is a casing string, and the wellhead spool is a casing head.

8. A system for locking together a running tool and a mandrel hanger to rotate a tubular string suspended from the mandrel hanger, comprising:

a mandrel hanger adapted to suspend the tubular string from a lower portion, the mandrel hanger being formed with a plurality of circumferentially spaced hanger ports;

a running tool adapted to engage in an internal mechanical connection to the mandrel hanger such that the running tool and the mandrel hanger are arranged concentrically and moveable longitudinally together;

a locking assembly having an outer locking tubular to be arranged around the mandrel hanger and the running tool, and being connected at an upper end to the running tool, the outer locking tubular being adapted to lock the mandrel hanger and the running tool together once the mandrel hanger and the running tool are engaged in the mechanical connection, so that torque applied to the running tool is applied to the mandrel hanger through the outer locking tubular to rotate the running tool, the hanger and the tubular string synchronously in a clockwise direction or a counterclockwise direction; and the locking assembly including locking pins arranged to engage in the hanger ports to contact a lower end of the outer locking tubular to move the outer locking tubular generally upwardly to unlock the mandrel hanger and the running tool when the mandrel hanger is landed on a load shoulder of a wellhead spool so that the mechanical connection can be disengaged.

9. The system of claim 8, wherein:

the mandrel hanger is formed with internal running threads at an upper portion; and the running tool is formed with threads to engage the internal running threads of the mandrel hanger to form the internal mechanical connection as a threaded connection;

such that the locking assembly is adapted to lock the mandrel hanger and the running tool together once the running tool is threaded onto the internal running threads of the mandrel hanger so that torque applied to the running tool is applied to the mandrel hanger through the outer locking tubular to rotate the running tool, the mandrel hanger and the tubular string synchronously in the clockwise direction or the counterclockwise direction, and such that the locking assembly unlocks the mandrel hanger and the running tool when the mandrel hanger is landed on the load shoulder of the wellhead spool so that the threaded connection can be reversed to disengage the running tool from the mandrel hanger.

10. The system of claim 9, wherein the mandrel hanger is a mandrel casing hanger, the tubular string is a casing string, and the wellhead spool is a casing head.

11. The system of claim 8, wherein the mandrel hanger is a mandrel casing hanger, the tubular string is a casing string, and the wellhead spool is a casing head.

12. A method of locking together a running tool and a tubular member to permit concentric longitudinal movement together and to rotate the tubular member prior to landing the tubular member in an outer tubular member, comprising:

a) forming a mechanical connection between the running tool and the tubular member such that the running tool and the tubular member are arranged concentrically and moveable longitudinally together;

b) locking the tubular member and the running tool together with a locking assembly;

c) applying torque to the running tool to transmit torque through the locking assembly to the tubular member and to rotate the running tool and the tubular member synchronously in a clockwise direction or a counterclockwise direction;

d) landing the tubular member on a shoulder of the outer tubular member to cause the locking assembly to unlock the tubular member and the running tool; and e) disengaging the mechanical connection between the running tool and the tubular member.

13. The method of claim 12, wherein:

the tubular member is a mandrel hanger formed with one or both of external running threads and internal running threads at an upper portion and being adapted to suspend a tubular string from a lower portion, and wherein the method further comprises coupling the tubular string to the mandrel hanger;

the running tool is formed with threads to engage the external or internal running threads of the mandrel hanger so that the mechanical connection is a threaded connection;

the outer tubular member is a wellhead spool having a load shoulder;

the locking assembly is adapted to lock the mandrel hanger and the running tool together once the running tool is threaded onto the mandrel hanger so that torque applied to the running tool is applied to the mandrel hanger through the locking assembly to rotate the running tool, the mandrel hanger and the tubular string synchronously in the clockwise direction or the counterclockwise direction, and the locking assembly unlocks the mandrel hanger and the running tool when the mandrel hanger is landed on the load shoulder of the wellhead spool so that the threaded connection can then be reversed to disengage the running tool from the mandrel hanger.

14. The method of claim 13, wherein the mandrel hanger is a mandrel casing hanger, the tubular string is a casing string, and the wellhead spool is a casing head.

* * * * *